United States Patent [19]

Block

[11] Patent Number: 5,000,622

[45] **Date of Patent: * Mar. 19, 1991**

[54] SHAKING CONTROL UNIT FOR A HYDRAULIC CYLINDER

[75] Inventor: Siegmar Block, Essen, Fed. Rep. of Germany

[73] Assignee: Bochumer Eisenhutte Heintzmann GmbH & Co. KG, Bochum, Fed. Rep. of Germany

[ * ] Notice: The portion of the term of this patent subsequent to Mar. 13, 2007 has been disclaimed.

[21] Appl. No.: 439,822

[22] Filed: Nov. 21, 1989

Related U.S. Application Data

[63] Continuation of Ser. No. 95,562, Sep. 10, 1987, Pat. No. 4,907,918.

[30] Foreign Application Priority Data

Sep. 12, 1986 [DE] Fed. Rep. of Germany ..... 3631079

[51] Int. Cl.[5] ..... E21D 23/26

[52] U.S. Cl. ..... 405/294; 91/417 R; 91/420; 405/302

[58] Field of Search ..... 405/291, 294, 299, 302, 405/303; 91/170 MP, 417 R, 420; 299/1, 33

[56] References Cited

U.S. PATENT DOCUMENTS

| | | | |
|---|---|---|---|
| 3,441,317 | 4/1969 | Dommann | 299/33 |
| 4,613,257 | 9/1986 | Weirich et al. | 405/302 |
| 4,657,443 | 4/1987 | Blumenthal | 405/302 |
| 4,693,640 | 9/1987 | Berger | 405/294 |
| 4,907,918 | 3/1990 | Block | 405/303 |

*Primary Examiner*—David H. Corbin

*Attorney, Agent, or Firm*—Toren, McGeady & Associates

[57] ABSTRACT

A shaking control unit for a hydraulic cylinder, wherein a first predetermined pressure is admitted to the piston space of the cylinder through a first hydraulic line. A three/two-way valve connects in its zero position a second hydraulic line to a return tank, the second hydraulic line being connected to the first hydraulic line through a check valve. A first control line leads from the first hydraulic line to a first control area of the three/two-way valve. A second control line leads from the second hydraulic line to a second control area of the three/two-way valve. The three/two-way valve is constructed in such a way that, when the pressure in the first hydraulic line reaches a second predetermined pressure which is greater than the first predetermined pressure, the three/two-way valve switches and connects the first hydraulic line to the second hydraulic line. If the piston of the hydraulic cylinder meets an obstacle, the pressure in the first hydraulic line rises above a certain limit value. This pressure acts on the first control area of the valve and switches the valve, so that the high pressure of the first line becomes suddenly effective in the piston space through the valve and the second line. This pressure switches back the valve after a certain period of time over the second control line.

1 Claim, 2 Drawing Sheets

SHAKING CONTROL UNIT FOR A HYDRAULIC CYLINDER

This is a Continuation of U.S. application Ser. No. 07/095,562 filed Sept. 10, 1987, now U.S. Pat. No. 4,907,918.

BACKGROUND OF THE INVENTION

1. Field of the Invention

The present invention relates to a shaking control unit for a hydraulic cylinder, wherein a first predetermined pressure is admitted to the piston space of the cylinder through a first hydraulic line.

2. Description of the Prior Art

Hydraulic cylinders are used in underground mining for a variety of purposes. For example, in shield-type support frames, so-called packing or sliding caps are synchronously advanced together with a conveyor hinged to the support frame. The cap is used to uphold the roof which is exposed due to the advancing extraction of coal and to close empty spaces. Since the extraction apparatus, for example, a coal plane, does not extend to the plane of the roof, upper coal or residual coal frequently remains attached to the roof. This residual coal presents an obstacle to the advancement of the sliding cap. The sliding cap may have at its front edge a tearing ledge or loosening wedge by means of which the cap separates the residual coal as it is being advanced with normal pressure. However, this advancement is only possible if the residual coal is not adhering too firmly.

Another field of application of hydraulic cylinders is the compacting of filling material which is introduced into the packing space. It is conceivable to use the hydraulic cylinder to compact the material to a certain extent.

If, in the above-explained example, the residual coal adheres very firmly to the roof of a seam, the pressure acting on the hydraulic cylinder actuating the sliding cap as the sliding cap is being advanced may not be sufficient to separate the residual coal. In these cases, it was necessary in the past to use hand tools. Therefore, it has been proposed that in cases like this the normal advancement of the sliding cap be superimposed by a shaking or vibrating movement of the sliding cap, i.e., an alternating loading and unloading of the sliding cap generated by pressure variations in the hydraulic cylinder. The pulse-like pressure increases are intended to separate the remaining coal from the roof of a seam.

It is, therefore, the primary object of the present invention to provide a shaking control unit for a hydraulic cylinder which creates with simple means pulse-like pressure variations in the piston space of the hydraulic cylinder in order to obtain a shaking effect.

SUMMARY OF THE INVENTION

In accordance with the present invention, a three/two-way valve connects in its zero or neutral position a second hydraulic line to a return tank, the second hydraulic line being connected to the first hydraulic line through a check valve. A first control line leads from the first hydraulic line to a first control area of the three/two-way valve. A second control line leads from the second hydraulic line to a second control area of the three/two-way valve. In addition, the three/two-way valve is constructed in such a way that, when the pressure in the first hydraulic line reaches a second predetermined pressure which is greater than the first predetermined pressure, the three/two-way valve switches and connects the first hydraulic line to the second hydraulic line.

The principal component of the control unit according to the present invention is the three/two-way valve. In its zero or neutral position, the three/two-way valve connects a second hydraulic line connected to the first hydraulic line with a return tank. When pressure is applied to the piston space of the hydraulic cylinder to extend the piston rod, a first predetermined pressure is built up in the first hydraulic line. When the movement of the piston rod is stopped because a part connected to the piston rod has made contact with an obstacle, the pressure in the first hydraulic line increases. This increased pressure reaches through the first control line to the first control area of the three/two-way valve.

The valve switches when a certain limit value, i.e., a second predetermined value, has been reached. As a result, the first hydraulic line is connected to the second hydraulic line. Since an increased pressure prevails in the first hydraulic line, this pressure is introduced suddenly through the second hydraulic line into the piston space of the hydraulic cylinder. This pulse-like pressure increase causes the piston rod to be pressed with temporarily increased force against the obstacle.

Simultaneously, the increased pressure in the second hydraulic line acts on the second control area of the three/two-way valve through the second control line. This increased pressure again returns the valve into its zero position. Thus, the initial condition is reached and the entire sequence is repeated.

In accordance with a preferred further development of the invention, an adjustable compression spring tensions the three/two-way valve in the zero position. Accordingly, the compression spring acts in the same direction as the pressure acting on the second control area. The adjustment of the compression spring determines the pressure at which the three/two-way valve is switched.

If an adjustable throttle is included in the second control line, it is possible by an appropriate adjustment of the throttle to obtain a more or less high frequency and, thus, a more or less high pressure peak in the piston space of the hydraulic cylinder. This is because the throttle, after the first hydraulic line has been connected to the second hydraulic line and the second control line, causes the pressure acting on the second control area to be decelerated during its increase as well as during its decrease. The behavior of the valve during switching can also be influenced with respect to time by selecting the first and second control areas of different size.

The control unit according to the present invention can be used in single-acting cylinders as well as in double-acting cylinders. However, the hydraulic cylinder preferably is a double-acting cylinder to whose piston space the first hydraulic line is connected and to whose annular space a third hydraulic line is connected, wherein an unlockable check valve is included in the first hydraulic line, the check line being connected through a third control line to the third hydraulic line. The unlockable check valve ensures that the pressure in the piston space is not decreased during the shaking procedure toward the first hydraulic line. If pressure is applied to the annular space, the check valve is unlocked to the control line connected to the third hydraulic line, so that the pressure can decrease from the piston space of the hydraulic cylinder.

Several fields of application of hydraulic cylinders have been mentioned above. The invention particularly provides that the shaking control unit is a component of a shaking apparatus for loosening the residual coal adhering to the roof of a seam by means of the sliding cap of a support frame. For this purpose, the shaking control unit is incorporated into a synchronization control of the support frame, so that the sliding cap is synchronously advanced together with the conveyor. The shaking control unit may also be used together with a hydraulic cylinder which serves to compact the material which has been introduced into the packing space. Other fields of application are conceivable.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
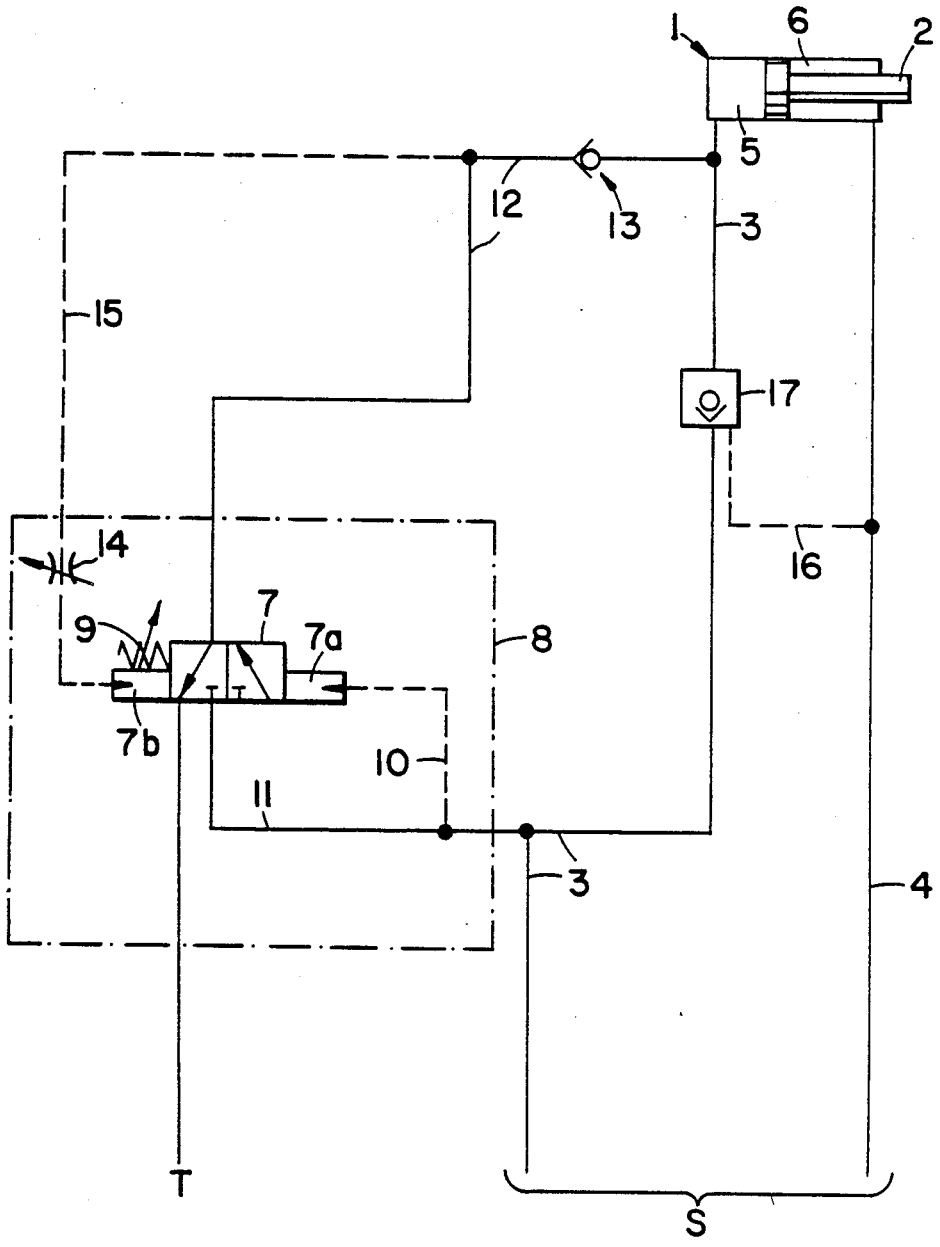
FIG. 1 shows a hydraulic circuit diagram of a shaking mechanism in accordance with the present invention.
Figure 2:
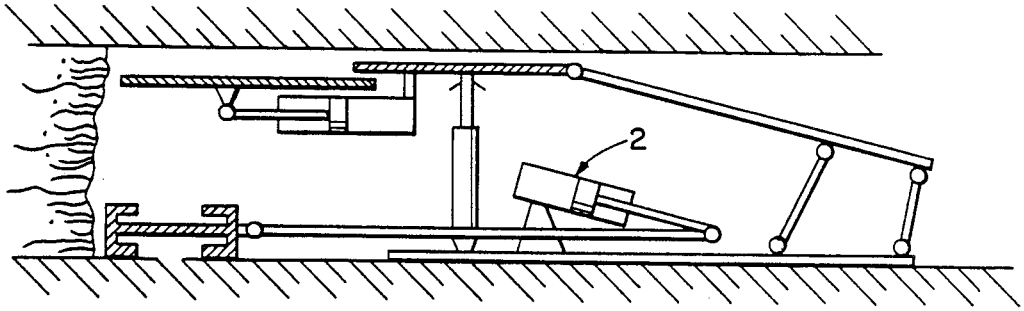
FIG. 2 shows a sectional view of the shaking control unit as part of a shaking mechanism.

The shaking mechanism illustrated in the drawing includes a double-acting cylinder 1 whose piston rod 2 moves the sliding cap of a shield-type support frame, not shown. This movement is carried out in synchronization with the advancement of the support conveyor.

The unit for the synchronization control is not illustrated in detail but is denoted by reference symbol S. The unit acts on two hydraulic lines 3 and 4, wherein line 3 is 3 is connected to the piston space 5 and line 4 is connected to annular space 6 of cylinder 1. By admitting pressurized fluid to the annular space 6, the sliding cap is retracted by means of piston rod 2. If pressurized fluid is admitted to piston space 5 through line 3, the piston 2 moves the sliding cap toward the coal face K. In doing so, a certain pressure is reached in line 3.

If the forward edge of the cap makes contact with an obstacle, for example, residual coal which has remained attached to the roof, the piston rod 2 comes to a standstill if the residual coal is not pushed off by the cap which is moved forwardly with normal force. As a consequence, the pressure in line 3 rises.

A three/two-way valve 7 of a shaking control 8 includes a first larger control area *7a* and a second smaller control area *7b*. An adjustable compression spring pretensions the valve 7 in the zero position illustrated in FIG. 1. When normal pressure is present in line 3 during the advancement of the piston rod 2, the pressure acting through control line 10 on the control area is not sufficient to switch the valve against the force of compression spring 9. However, when the pressure in line 3 is increased as the residual coal stops the advancement of the piston rod 2, valve 7 is suddenly opened and spring 9 is compressed when a certain limit value of valve 7 adjusted by means of compressions spring 9 has been reached. As a result, the increased pressure in branch line 11 connected to line 3 reaches suddenly in the piston space 5 of cylinder 1 through line 7, a line 12 and a check valve 13. This increased pressure causes the front edge of the sliding cap constructed as a tearing ledge with increased force between the residual coal which has remained attached to the roof and the rock.

The increased pressure in line 12 additionally acts on control area *7b* of valve 7 through control line 12 which contains a throttle 14. Together with the pressure generated by compression spring 9, this increased pressure is sufficient to switch back valve 7, so that line 12 is again connected to a return tank T, as is control line 5, however, the latter connection being effected with a time delay caused by throttle 14.

If the obstacle of residual coal is still present, the above-described conditions again prevail and the above-described procedure is repeated with a frequency which can be adjusted by throttle 14. Accordingly, the front edge of the sliding cap acts on the residual coal at the contact point alternatingly with high and low pressure, i.e., in a pulse-like manner. This makes it possible to separate the residual coal.

A control line 16 connects line 4 to check valve 17 which can be unlocked. Check valve 17 prevents the pressure from decreasing in the piston base 5 and in line 3 during the shaking procedure. During manual operation, piston rod 2 is retracted by applying pressure to the annular space 6 through line 4. By unlocking check valve 17 through control line 16, the pressure prevailing in piston space 5 can be released into line 3.

Of course, it is apparent that the hydraulic cylinder 1 can be utilized for purposes other than the example described above. For example, the cylinder can be used for compacting material introduced into the packing space. For compacting the material, a plunger or the like is connected to piston rod 2. A certain pressure is applied to the piston space through the first hydraulic line 3. The shaking mechanism then operates in the above-described manner.

While a specific embodiment of the invention has been shown and described in detail to illustrate the application of the inventive principles, it will be understood that the invention may be embodied otherwise without departing from such principles.

I claim:

1. A shaking mechanism for separating residual coal attached to the roof of a seam by means of a sliding cap of a support frame, the shaking mechanism comprising a shaking control unit for a hydraulic cylinder defining a piston space, wherein a first predetermined pressure is admitted to the piston space through a first hydraulic line, comprising:

(a) a three/two-way valve having first and second control areas, and capable of assuming a zero position, a second hydraulic line being connected to a return means by the three/two-way valve when the two-way valve is in the zero position, wherein the second hydraulic line is connected to the first hydraulic line over a check valve.

(b) a first control line connecting the first hydraulic line with the first control area of the three/two-way valve, (c) a second control line connecting the second hydraulic line with the second control area of the three/two-way valve, and (d) the three/two-way valve being capable of switching when the pressure in the first hydraulic line exceeds a second predetermined pressure which is greater than the first predetermined pressure, wherein the three/two-way valve after switching connecting the first hydraulic line to the second hydraulic line, the unit being incorporated in a synchronization control of the support frame, the unit being capable of advancing the sliding cap synchronously with a conveyor.

* * * * *